US006224013B1

(12) United States Patent
Chisolm

(10) Patent No.: US 6,224,013 B1
(45) Date of Patent: May 1, 2001

(54) TAIL FIN DEPLOYMENT DEVICE

(75) Inventor: Bruce E. Chisolm, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/140,963

(22) Filed: Aug. 27, 1998

(51) Int. Cl.[7] ..... F42B 10/06
(52) U.S. Cl. ..... 244/3.27; 244/3.3; 244/49
(58) Field of Search ..... 244/3.27, 3.28, 244/3.3, 49

(56) References Cited

U.S. PATENT DOCUMENTS

| | | | | |
|---|---|---|---|---|
| 1,318,955 | | 10/1919 | Barlow . | |
| 2,494,885 | | 1/1950 | Lax et al. . | |
| 2,661,689 | | 12/1953 | D'Assis Fonseca . | |
| 3,304,030 | * | 2/1967 | Weimholt et al. | 244/3.28 |
| 3,861,627 | * | 1/1975 | Schoffl | 244/3.28 X |
| 5,114,095 | * | 5/1992 | Schroppel et al. | 244/3.28 |
| 5,820,072 | * | 10/1998 | Na et al. | 244/49 |

FOREIGN PATENT DOCUMENTS

| | | | | |
|---|---|---|---|---|
| 0389358 | * | 9/1990 | (EP) | 244/3.28 |
| 896502 | * | 2/1945 | (FR) | 244/3.28 |

* cited by examiner

*Primary Examiner*—Peter M. Moon
*Assistant Examiner*—Son T. Nguyen
(74) *Attorney, Agent, or Firm*—Burns, Doane, Swecker & Mathis, LLP

(57) ABSTRACT

A retention and deployment mechanism for pivotable guide fins on bombs or missiles includes a cup shaped yoke slidably mounted on a shaft. The device is mounted in a central region of the bomb tail and engages tabs on each of the fins. The tabs are held between a retaining flange and pusher arms extending radially from the yoke. The retaining flange prevents pivoting of the fins until desired. A drive spring causes the yoke to slide axially, and the pusher arms push on the fins to cause pivoting to the deployed position. The yoke includes a head end with a cone shaped recess. Four balls seated in holes in the shaft contact the cone shaped recess to prevent movement of the yoke. A pin disposed in a bore in the shaft hold the balls in the seats. The pin includes a groove, and is movable by a spring to a position where the balls fall into the groove, thus releasing the yoke. A lanyard is attached to the aircraft and extends through aligned holes in the shaft and pin to retain the pin in position. When the bomb is released from the aircraft, the lanyard is pulled from the holes, releasing the pin.

12 Claims, 4 Drawing Sheets

TAIL FIN DEPLOYMENT DEVICE

The present invention relates to aerial bombs and missiles, and the guide fins mounted to aerial bombs and missiles. More particularly, the invention is directed to a device for retaining fins in a folded, stowed position and for deploying the fins upon release of the bomb or missile from an aircraft.

BACKGROUND AND SUMMARY OF THE INVENTION

Bombs and missiles which are deployed from aircraft typically include guidance fins or wings for controlling flight after release from the aircraft. Space considerations on the aircraft typically require that the fins be folded in a stowed position while being carried on the aircraft. This is naturally of more concern with larger bombs. Folded fins, of course, create the need for a mechanism to deploy the fins upon release from the aircraft.

One class of known mechanisms includes electrical or squib devices for retaining and deploying fins. Another known device includes a band that wraps around an outer edge of the stowed fins and individual deployment springs that act on the fins when the band is released.

The conventional mechanisms suffer from deficiencies. The electrical and squib devices are effective with smaller fins, but are less effective with larger fins because of the dynamics involved in deploying larger fins after release from a moving aircraft. The wraparound band and spring devices have problems related to the complexity of the structure. The band includes a subassembly of small parts that can become loose and damage the aircraft (for example, by being sucked into the engine) when the band is released. In addition, the individual springs for driving the fins to the deployed position must work simultaneously. A weak or broken spring could cause a failure to deploy a fin or cause late deployment of a fin, either of which could result in an adverse flight response. Adverse flight of a bomb or missile could, among other things, turn the bomb into the aircraft flight path, which poses a serious danger to the aircraft.

The invention provides an apparatus for retaining fins in stowed position and deploying the fins upon release from an aircraft that eliminates the problems in the art.

The invention includes a single device that both retains the fins in the stowed position, and with spring power, acts to cause the fins to pivot from the stowed position to the deployed position. Thus, the number of parts and the complexity of the device are reduced, compared to the known art. In addition, no part of the apparatus according to the invention becomes loose or free, and there is therefore no danger of flying parts damaging the aircraft or engine.

According to the invention, the device for retaining and deploying fins includes a yoke mounted for sliding axially on a shaft. The yoke is positioned at a radially central location at a missile or bomb tail to engage edges of the pivotally mounted fins that are inwardly facing in the stowed position. A drive spring is mounted between a fixed support and the yoke. When released, the drive spring drives the yoke along the shaft. The yoke pushes against the fins, causing them to pivot from the stowed position to the deployed position. The drive spring is selected to store a sufficiently high amount of energy to overcome inertia in the fins and air resistance working against pivoting, thus ensuring deployment of the fins.

The yoke is conveniently shaped as a cup-like member mounted on the shaft, with the drive spring disposed around the shaft in the cup interior, which helps maintains the linear orientation of the components during deployment. Linear movement of the cup is translated to pivoting movement of the fins by the yoke pushing each fin at an engagement point located a distance from the fin pivot point.

According to a preferred embodiment of the invention, the fins each include a tab extending from the inwardly facing edges. The yoke includes radially extending arms at a first end and a radially extending ring spaced from the arms, the area between the arms and the ring defining an engagement space for the tab. The tabs are received in the space between the arms and the ring, and are prevented from pivoting and thus retained in the folded position by the ring. The arms push on the fin tabs when the yoke is driven by the spring to cause the fins to pivot.

According to another aspect of the invention, a mechanism for releasably retaining the yoke in the stowed position includes a plurality of balls disposed in holes in the spring shaft and bearing on the end of the cup. The balls prevent the cup from moving relative to the spring shaft. The balls are retained in position in the holes by a retaining pin disposed inside the spring shaft. The retaining pin includes recesses for receiving the balls when the pin is moved to a release position.

A retaining spring is disposed in the spring shaft for driving the retaining pin to the release position. A lanyard extends through aligned holes in the spring shaft and retaining pin to hold the retaining pin against the retaining spring. When the lanyard is withdrawn, the retaining spring drives the retaining spring to the release position, which allows the balls to drop into the recesses and no longer bear on the cup. The cup is then free to move under power of the drive spring to deploy the fins.

The use of the retaining pin and spring arrangement provides a mechanical advantage in retaining the yoke cup against the drive spring with the balls and retaining pin, and consequently, requiring movement of the pin to release the yoke, which requires a much smaller force than needed for the drive spring. The lanyard holding the retaining pin in place is thus under a greatly reduced force. Release of the cup for deploying the fins thus requires less force as the lanyard is pulled out against the force of the retaining spring, which is lower than that of the drive spring.

BRIEF DESCRIPTION OF THE DRAWINGS

The invention will be better understood by reference to the following detailed description in conjunction with the appended drawings, in which.

DETAILED DESCRIPTION

Figures 1, 2:
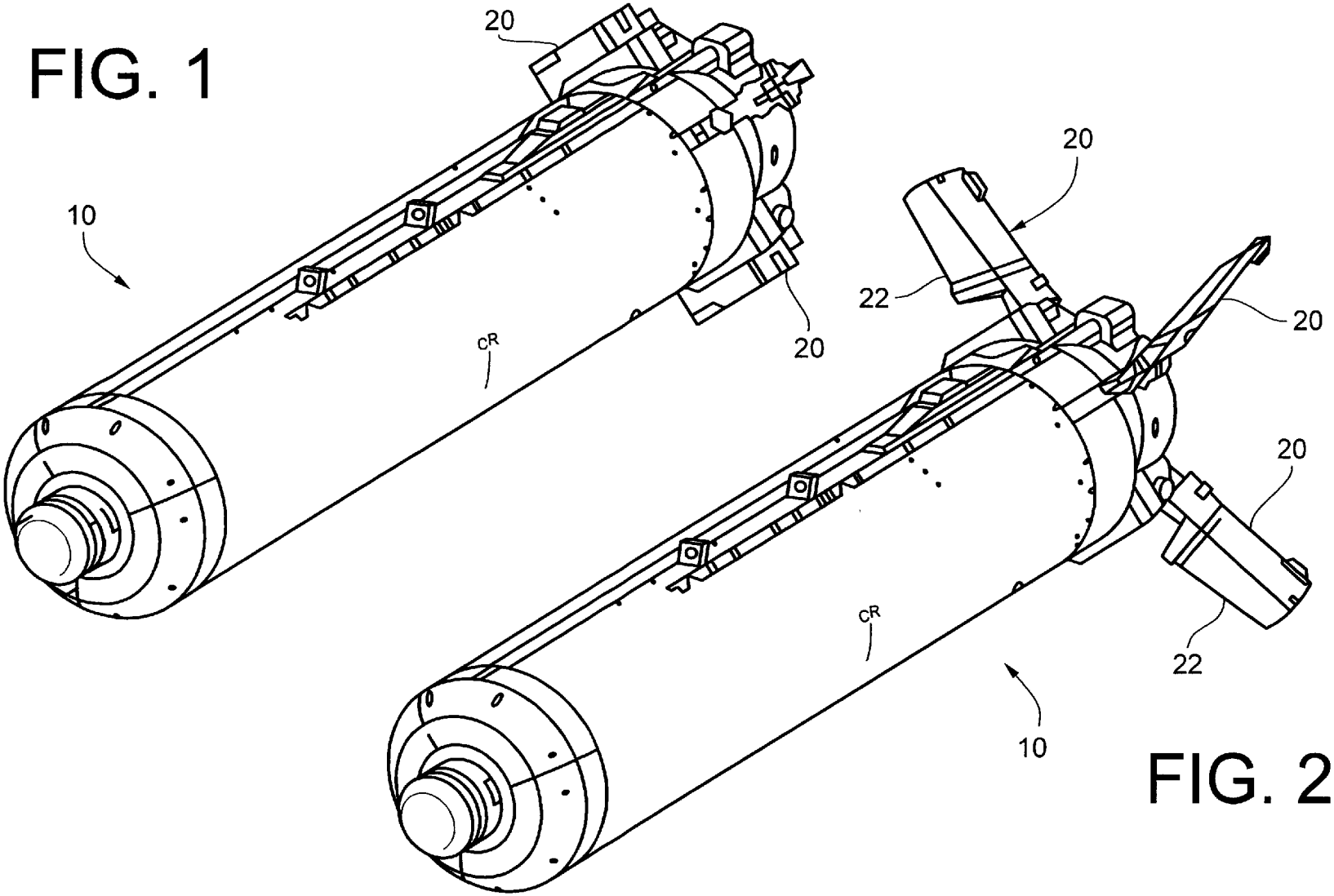
FIG. 1 is a perspective view of an exemplary bomb casing with stowed tails fins.
FIG. 2 is a view of the bomb shown in FIG. 1 with the tail fins deployed.

In FIGS. 1 and 2, a bomb 10 is illustrated having pivotably deploying fins 20 at a tail end of the bomb, the fins are shown stowed in FIG. 1 and deployed in FIG. 2. The particular bomb shown is for illustrative purposes. The fin deploying device of the invention can be used with bombs or missiles that are dropped or launched from aircraft in which space restrictions make folding or pivoting fins advantageous.

The fins 20 are mounted to the bomb to pivot so that an edge 22 that is inwardly facing in the stowed position is the leading edge in the deployed position. Wind resistance keeps the fins 20 in the deployed position, so that no locking mechanism is required.

Figure 3:
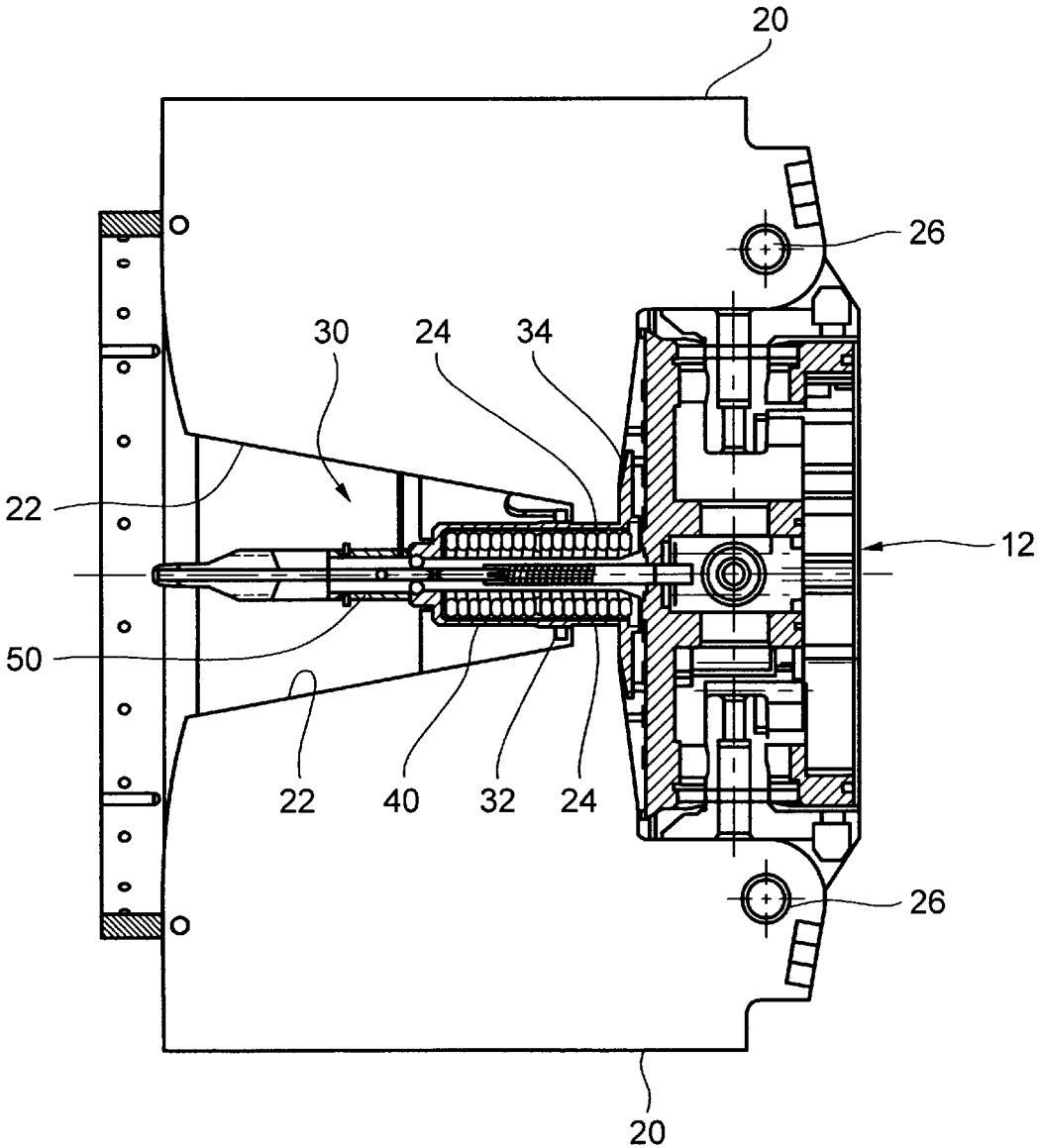
FIG. 3 is a sectional view of a tail section of a bomb showing the tail fin deployment device in accordance with the invention.

FIG. 3 is a sectional view of a tail section of the bomb showing the fin deployment device 30 retaining the fins 20 in the stowed position. The forward end of the bomb is to the left in the figure. The fins 20 are mounted to the bomb tail casing or frame 12 by a pivot 26. The fins 20 include on the inward edge 22 a tab 24 extending therefrom.

The fin deployment device 30 includes a yoke 40 mounted to slide on a shaft 50. Each fin tab 24 is held in the stowed position by a fin retaining flange 32 extending from an outer surface of the yoke 40. The flange 32 prevents pivoting of the fm from the stowed position. To deploy the fins, the yoke 40 includes pusher arms 34 that push forcefully against the tabs as the yoke slides in the forward direction (to the left in the figure).

The invention thus improves on the art by providing a single mechanism to both hold the fins in a stowed position and deploy the fins. The mechanism is permanently mounted at a central region of the host bomb or missile, which ensures a compact overall structure. Further, no parts of the device are shed or broken away upon deployment of the fins, thus eliminating the risk of damage to the aircraft.

Figure 4:
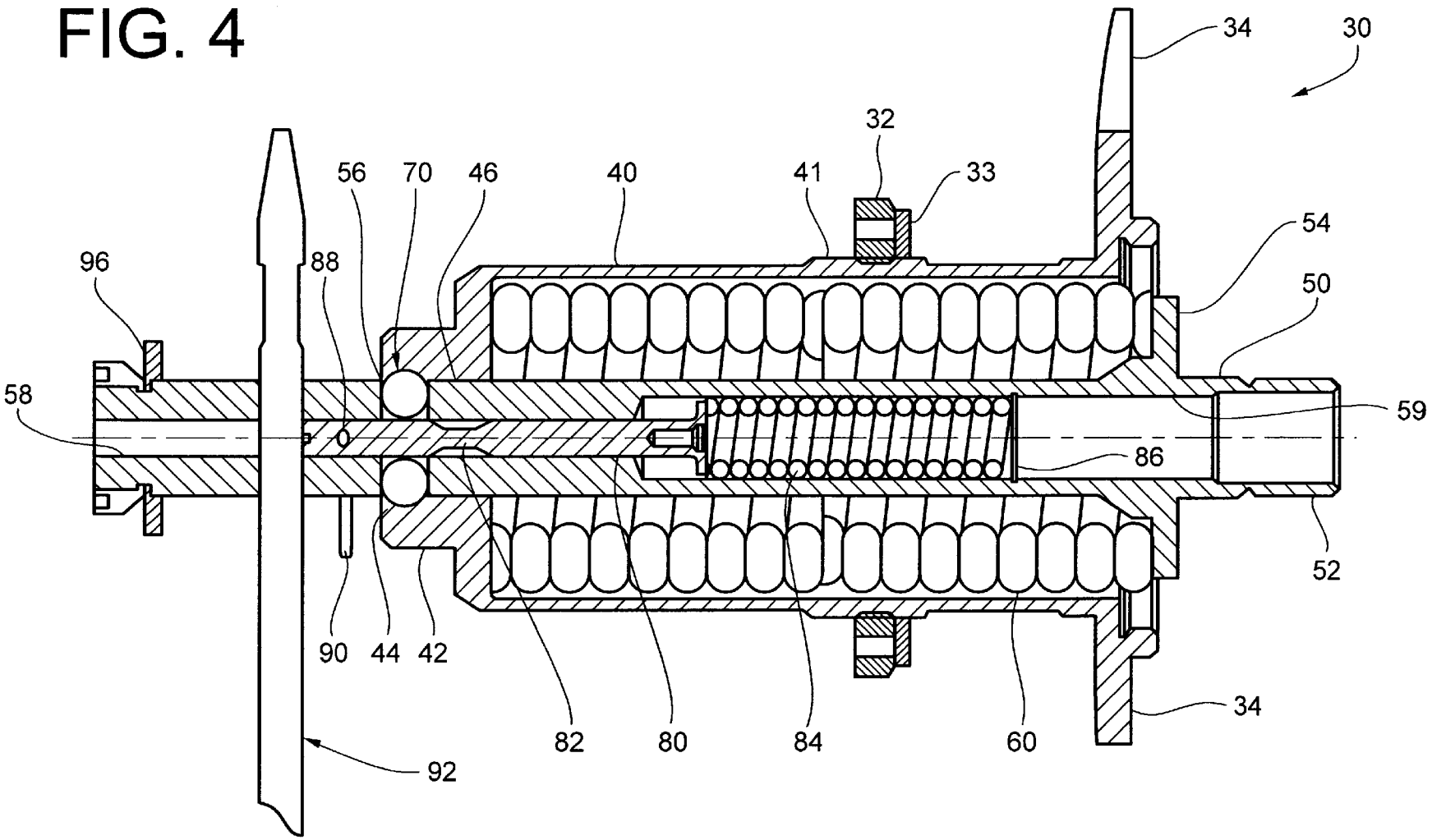
FIG. 4 is a sectional view of the device removed from the bomb tail.
Figure 5:
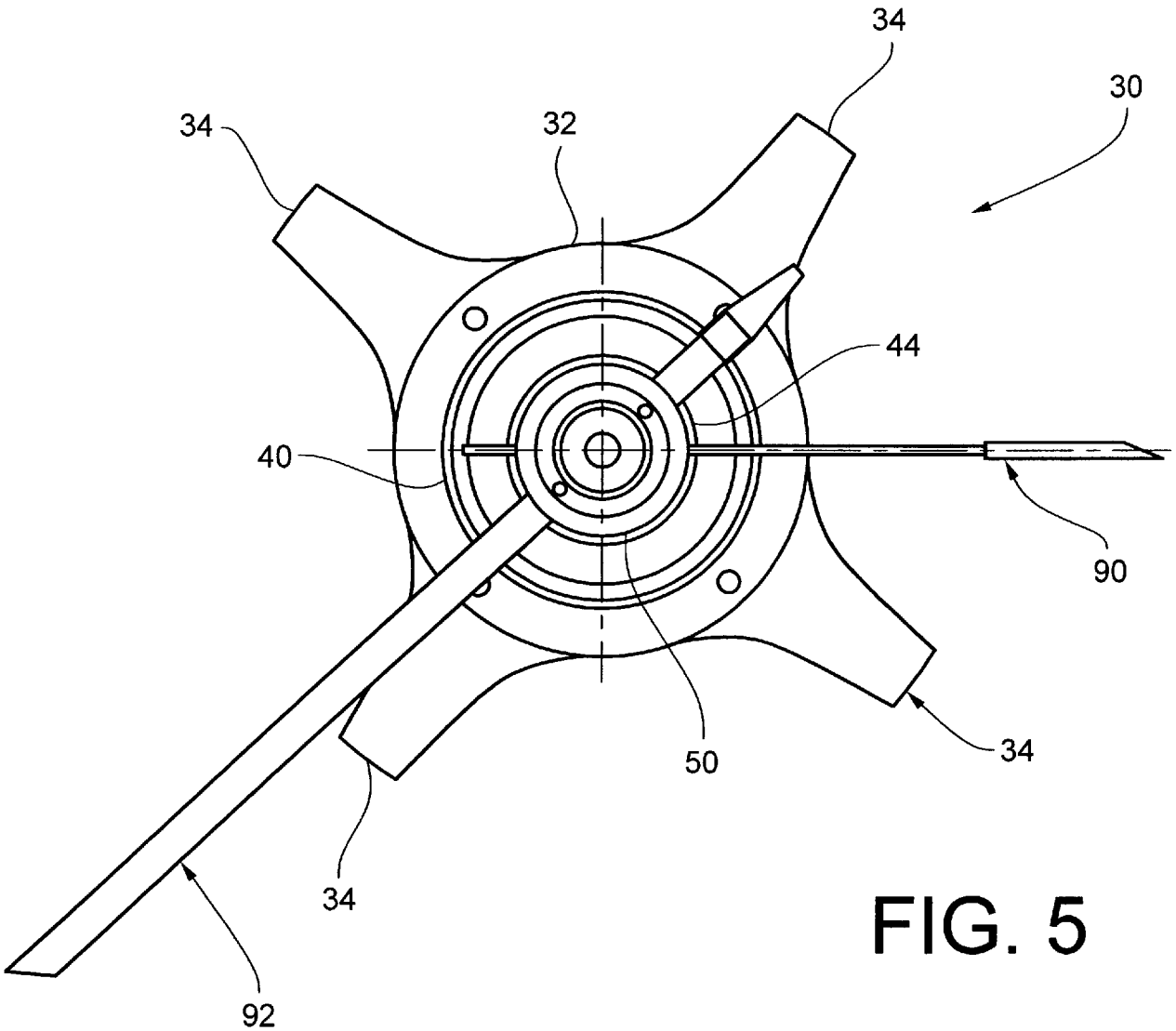
FIG. 5 is an end view of the device shown in FIG. 4 looking from the left of the view of FIG. 4.

FIGS. 4 and 5 show the details of the deployment device 30, illustrated in a stowed position. The yoke 40, mentioned above, is a cup-shaped element that is slidably mounted on a spring shaft 50. The yoke or cup 40 has a tubular body with an end wall 42 shaped to form a conical recess 44 leading to a through hole 46. The spring shaft 50 extends through the through hole 46. The spring shaft 50 is fastened to the bomb tail casing or frame by a threaded end portion 52. The pusher arms 34 extend radially outward from a base end of the yoke 40.

For convenience, the yoke can be made of three parts: a nose section with the end wall and recess, a tubular body fitted to the nose section, and an arm piece that fits over the end of the tubular body.

As mentioned above, the fin tabs 24 are held between the flange 32 and the pusher arms 34 when the fins 20 are in the stowed position. In a presently preferred embodiment, the flange 32 is an internally threaded ring that is screwed onto screw threads 41 formed on the outer surface of the cup 40. The flange 32 can be adjusted by turning on the screw threads to secure the fins tightly against the arms 34 in the stowed position. A plastic washer 33 is positioned adjacent the flange 32 as a cushion to prevent damaging the fins.

A drive spring 60 is disposed in the interior of the cup 40 between the end wall 42 of the cup and a flange 54 on the spring shaft 50. The drive spring 60 provides motive power to move the cup 40 from the stowed position, shown in FIG. 4, to a deployed position, which is to the left in the figure along the spring shaft 50.

The cup 40 is held in the stowed position against the compressed drive spring 60 force by a plurality of balls 70 carried in seat holes 56 in the spring shaft 50. The balls 70 bear on the conically shaped end wall 44 of the cup to prevent sliding movement. Preferably, four balls are used and, accordingly, four seat holes distributed circumferentially about the spring shaft 50, to provide a relatively large contact area on the cup end wall 44 without compromising the strength of the spring shaft.

The mechanism for releasing the cup 40 to deploy the fins is based allowing the balls 70 to move from the cup end wall 44 into the spring shaft 50. The conically shaped end wall 44 exerts a force component tending to move the balls 70 radially inward toward the center of the spring shaft 50. The balls 70 are prevented from moving inward by a retaining pin 80 slidably disposed in an internal cavity 58 in the spring shaft 50. Thus, in the position shown in FIG. 4, with the retaining pin 80 in position supporting the balls 70, the balls resist movement of the cup 40 to retain the device in the stowed position.

To release the cup 40 for deploying the fins, the retaining pin 80 is moved in the cavity 58 to allow the balls 70 to fall into a groove or recess 82 formed in the retaining pin 80. Movement of the retaining pin 80 is powered by a retaining spring 84 disposed in a bore 59 formed in the spring shaft 50. The retaining spring 84 is disposed between the retaining pin 80 and a snap ring 86 fastened inside the bore 59. The retaining spring 84 biases the retaining pin 80 to move leftward in FIG. 4.

The retaining pin 80 is held in position by a lanyard 90 that extends through aligned holes 88 in the spring shaft 50 and the retaining pin 80. The lanyard 90 has sufficient shear strength to resist the force of the retaining spring 84 without breaking. When the lanyard 90 is pulled from the holes 88, the retaining spring 84 and retaining pin 80 are unconstrained, allowing the pin to move leftward. The balls 70 fall into the recess 82, and no longer bear on the cup 40, which, correspondingly, allows the cup to move under power of the drive spring 60.

The lanyard 90 is attached to the aircraft so that dropping the bomb or missile out of the aircraft causes the lanyard, when it reaches the end of its length, to be pulled or withdrawn from the holes to automatically release the deploying device 30.

The ball 70 and retaining pin 80 system provides a mechanical advantage by directing the drive spring force against the balls 70 and retaining pin 80. Release of the device is achieved by moving the retaining pin 80 axially against the radially directed force component exerted by the balls 70. The lanyard 90 is pulled out against the force of the retaining spring 84, which is much less than the force of the drive spring 60 for deploying the fins 20. Pulling the lanyard 90 out is therefore easier to accomplish, and accordingly, more reliably done.

As an example, for the bomb shown in FIGS. 1 and 2, the fins weigh about 3.5 lbs. each, and the drive spring force is about 1600 lbs. to ensure full and rapid deployment of the fins. Pulling a lanyard against 1600 lbs., as well as providing a lanyard that will stand up to 1600 lbs. when in the holes, present difficulties. With the device of the invention, the retaining spring 84 can overcome the force on the balls 70 exert on the retaining pin with about 300 lbs. of force. Thus, withdrawing the lanyard 90 is resisted by the retaining spring 84 force of 300 lbs., and not the much larger force of the drive spring 60.

A safety rod 92 inserted through a second set of aligned holes in the spring shaft 50 is used to ensure that the device 30 is not released during transport of the bomb or missile prior to loading on an aircraft. A free end of the retaining pin 80 abuts the safety rod 50 and is prevented from moving. The safety rod 92 can, of course, also be used when the bomb is loaded on an aircraft, but is not to be deployed.

To stop the cup 40 in the deployed position while preventing unwanted shock from being transmitted to the aircraft, a crushable washer 96 is mounted at the end of the spring shaft 50. The crushable washer 96 is formed of aluminum and is deformable to absorb collision energy of the moving cup 40 and dampen the shock.

The device can, of course, be modified to accommodate different bombs or missiles. For example, the drive spring can easily be changed to provide the appropriate power for the size of the fins, and the length of travel of the yoke can be adjusted for different size fins by changing the length of the spring shaft.

In addition, other variations are possible. The retaining pin 80 can alternatively be mounted for movement in the opposite direction, in which case the retaining ring is removed, and the retaining spring is positioned between the head of the retaining pin and the inside end of the spring shaft bore. In this embodiment, both the safety rod and lanyard are inserted through aligned holes in the spring shaft and retaining pin.

The invention has been described in terms of preferred embodiments, principles, and examples. Those skilled in the art will recognize that substitutions and equivalents may be made without departing from the scope of the invention as defined in the following claims.

What is claimed is:

1. A retaining and deployment device for bomb or missile tail fins pivotable from a stowed position to a deployed position, comprising:

a movable yoke slidably mounted on a spring shaft, the yoke having a stowed position for retaining tail fins in a stowed position and a deployed position for moving the tail fins to a deployed position, the yoke having means for engaging radially inwardly facing portions of tail fins in the stowed position;

a drive spring mounted in contact with said yoke and storing energy in a stowed position for driving said yoke from the stowed position to the deployed position, wherein while being driven by the spring, the yoke pushes the inwardly facing portions to cause the fins to pivot toward the deployed position; and locking means for releasably retaining the yoke and spring in the stowed position;

wherein the shaft is mountable on a bomb or missile frame, and the yoke is a cup-shaped element having a tubular body with an end wall, the yoke being mounted on the spring shaft with the spring shaft extending through a center hole in the end wall, and wherein the drive spring is disposed in an interior of the yoke and surrounds the spring shaft, the drive spring acting on the end wall.

2. The device as claimed in claim 1, wherein said means for engaging inwardly facing portions of the tail fins includes radially extending arms at a tail end of the cup and a radially extending ring spaced from the arms, a portion of the tail fins being receivable between the ring and the arms to prevent pivoting movement.

3. The device as claimed in claim 1, wherein the end wall of the spring cup is shaped as a conical recess, and wherein said locking means includes radially extending holes in the spring shaft opening to a center bore in the spring shaft, a plurality of balls disposed in the holes and bearing on the conically shaped end wall to hold the spring cup in the stowed position, and a retaining pin disposed in the center bore of the spring shaft for axial sliding movement therein, the retaining pin retaining the balls in the holes.

4. The device as claimed in claim 3, wherein the retaining pin includes a recessed portion alignable with the holes to receive the balls when the retaining pin is moved to a deployed position, a retaining spring disposed in the spring shaft center bore and bearing on the retaining pin to bias the retaining pin to a deployed position upon release, and a release lanyard extending through aligned holes in the spring shaft and retaining pin to hold the retaining pin in a stowed position, wherein withdrawal of the lanyard from the aligned holes releases the retaining spring and retaining pin to permit movement to the deployed position.

5. The device as claimed in claim 1, further comprising a deformable washer mounted at an end of the spring shaft to absorb impact forces and stop the spring cup at the end of the spring shaft.

6. A retaining and deployment device for bomb or missile tail fins pivotable from a stowed position to a deployed position, comprising:

a movable yoke slidably mounted on a spring shaft, the yoke having a stowed position for retaining tail fins in a stowed position and a deployed position for moving the tail fins to a deployed position, the yoke having means for engaging radially inwardly facing portions of tail fins in the stowed position;

a drive spring mounted in contact with said yoke and storing energy in a stowed position for driving said yoke from the stowed position to the deployed position, wherein while being driven by the spring, the yoke pushes the inwardly facing portions to cause the fins to pivot toward the deployed position;

locking means for releasably retaining the yoke and spring in the stowed position; and a deformable washer mounted at an end of the spring shaft to stop the yoke and absorb impact forces.

7. A device for deploying guide fins on a tactical bomb or missile, the tail fins being pivotable from a stowed position to a deployed position, the device comprising:

a spring shaft mountable on a bomb tail, the spring shaft having an axially extending interior cavity and having radially extending holes opening to the cavity;

a spring cup having a tubular body, an end wall with a center hole at a head end and radially extending arms at a tail end, the spring cup mounted for axial sliding on the spring shaft, the spring shaft extending through the hole in the end wall, wherein, in the stowed position the radially extending holes of the spring shaft are positioned outside the cup adjacent the end wall;

a main spring disposed in the tubular body of the spring cup to bias the spring cup for movement relative to the spring shaft;

balls disposed in the radially extending holes of the spring shaft and bearing on the end wall of the spring cup for holding the spring cup in a stowed position;

a retaining ring mounted to an outer surface of the spring cup, the arms and the retaining ring defining a space therebetween for engaging edges of stowed tail fins;

a retaining pin disposed in the interior cavity of the spring shaft for axial sliding therein, the retaining pin having recesses to receive the balls when moved to a deployed position;

a retaining spring disposed in the spring shaft and bearing on the retaining pin to bias the retaining pin to the deployed position; and, a release lanyard extending through aligned holes in the spring shaft and retaining pin to hold the retaining pin in a stowed position, wherein withdrawal of the lanyard from the aligned holes releases the retaining spring and retaining pin to move to the deployed position.

8. A pivotable tail fin deploying apparatus for a bomb, comprising:

a plurality of tails fins mounted by pivots to a bomb assembly, the tail fins having a stowed position generally axially aligned with a bomb casing and a deployed position extending laterally from the bomb casing, each fin having an edge that is inwardly facing in the stowed position, each edge including a tab;

a yoke mounted on a shaft for sliding relative to the pivots, the yoke having a first position for retaining the fins in the stowed position and a second position for deploying the fins, the yoke engaging the tabs of the fins in the stowed position;

a spring for driving the yoke from the first position to the second position; and retaining means for retaining the yoke in the first position against force of the spring;

wherein the yoke includes radially extending arms at a tail end and a radially extending ring spaced from the arms, the fin tabs being received between the ring and the arms, wherein during movement of the yoke from the first position to the second position, the arms push on the fin tabs to cause pivoting movement of the fins.

9. A pivotable tail fin deploying apparatus for a bomb, comprising:

a plurality of tails fins mounted by pivots to a bomb assembly, the tail fins having a stowed position generally axially aligned with a bomb casing and a deployed position extending laterally from the bomb casing, each fin having an edge that is inwardly facing in the stowed position, each edge including a tab;

a yoke mounted on a shaft for sliding relative to the pivots, the yoke having a first position for retaining the fins in the stowed position and a second position for deploying the fins, the yoke engaging the tabs of the fins in the stowed position;

a spring for driving the yoke from the first position to the second position; and retaining means for retaining the yoke in the first position against force of the spring wherein the yoke comprises a spring cup having a tubular body with an end wall, the spring cup mounted for axial sliding on the shaft with the shaft extending through a center hole in the end wall, and wherein the drive spring is disposed in the spring cup and surrounds the shaft, the drive spring acting on the end wall of the spring cup.

10. The tail fin apparatus as claimed in claim 9, wherein an outer surface of the end wall of the spring cup is shaped to form a conical recess, and wherein said locking means includes radially extending holes in the spring shaft opening to the shaft cavity, a plurality of balls disposed in the holes and bearing on the conically shaped end wall to hold the spring cup in the stowed position, and a retaining pin disposed in the interior cavity of the spring shaft for axial sliding movement therein, the retaining pin retaining the balls in the holes.

11. The tail fin apparatus as claimed in claim 9 wherein the retaining pin includes recesses to receive the balls when the retaining pin is moved to a deployed position, a retaining spring disposed in the spring shaft and bearing on the retaining pin to bias the retaining pin to a deployed position upon release, and a release lanyard extending through aligned holes in the shaft and retaining pin to hold the retaining pin in a stowed position, wherein withdrawal of the lanyard from the aligned holes releases the retaining spring and retaining pin to permit movement to the deployed position.

12. A pivotable tail fin deploying apparatus for a bomb, comprising:

a plurality of tails fins mounted by pivots to a bomb assembly, the tail fins having a stowed position generally axially aligned with a bomb casing and a deployed position extending laterally from the bomb casing, each fin having an edge that is inwardly facing in the stowed position, each edge including a tab;

a yoke mounted on a shaft for sliding relative to the pivots, the yoke having a first position for retaining the fins in the stowed position and a second position for deploying the fins, the yoke engaging the tabs of the fins in the stowed position;

a spring for driving the yoke from the first position to the second position;

retaining means for retaining the yoke in the first position against force of the spring; and a deformable washer mounted on the shaft at an end of a yoke travel path to absorb impact forces and stop the yoke.

* * * * *